US006528459B1

(12) United States Patent
Roman

(10) Patent No.: US 6,528,459 B1
(45) Date of Patent: Mar. 4, 2003

(54) MARINE LUBRICANT FOR TWO-STROKE ENGINE

(75) Inventor: Jean-Philippe Roman, Lyons (FR)

(73) Assignee: Elf Antar France, Courbevoie (FR)

( * ) Notice: Subject to any disclaimer, the term of this patent is extended or adjusted under 35 U.S.C. 154(b) by 0 days.

(21) Appl. No.: 09/600,158

(22) PCT Filed: Jan. 29, 1999

(86) PCT No.: PCT/FR99/00181

§ 371 (c)(1),
(2), (4) Date: Sep. 18, 2000

(87) PCT Pub. No.: WO99/38940

PCT Pub. Date: Aug. 5, 1999

(30) Foreign Application Priority Data

Feb. 2, 1998 (FR) ..... 98 01127

(51) Int. Cl.[7] ..... C10M 141/12

(52) U.S. Cl. ..... 508/192; 508/291; 508/295; 508/398; 508/572

(58) Field of Search ..... 508/192, 291, 508/295, 398, 572

(56) References Cited

U.S. PATENT DOCUMENTS

| | | | |
|---|---|---|---|
| 4,375,418 | A | 3/1983 | Zoleski |
| 4,420,407 | A | 12/1983 | Sung |
| 4,842,755 | A | 6/1989 | Dunn |
| 5,320,763 | A | 6/1994 | Campbell |
| 6,339,051 | B1 * | 1/2002 | Carey et al. |

FOREIGN PATENT DOCUMENTS

| | | |
|---|---|---|
| EP | 0 331 359 A | 9/1989 |
| EP | 0 839 894 A | 5/1998 |
| WO | WO 96 20265 A | 7/1996 |

* cited by examiner

*Primary Examiner*—Jerry D. Johnson
(74) *Attorney, Agent, or Firm*—Oblon, Spivak, McClelland, Maier & Neustadt, P.C.

(57) ABSTRACT

The invention concerns a lubricant for a two-stroke slow speed crosshead marine engine, powered with a fuel with sulfur content not less than 1%, consisting of a mixture of distillates used as lubricating bases containing x wt. % of dispersing additive of the succinimide type, y wt. % of an overbased detergent additive of the sulfonate type, and z wt. % of an overbased detergent additive of the phenate type. The invention is characterized in that x, y and z are selected in the intervals $0.5 \leqq x \leqq 2.5$, $2.5 \leqq y \leqq 10$ and $11 \leqq z \leqq 24.5$ such that $15 \leqq x+y+z \leqq 36$ and $1.5 \leqq y/x \leqq 13$, the BN of the lubricant, determined according to the ASTM D-2896 standard, is not less than 70 mg KOH/g, and the speed at which sulfuric acid is neutralized by the lubricant, defined by the maximum speed of pressure increase of a closed chamber, with its walls covered with a film of said lubricant from 80 to 100 $\mu$m thick, maintained at 100° C., wherein is introduced a known amount of sulfuric acid, has a value not less than $11 \times 10^2$ Pa/s at 100° C.

12 Claims, 2 Drawing Sheets

MARINE LUBRICANT FOR TWO-STROKE ENGINE

Figure 1:
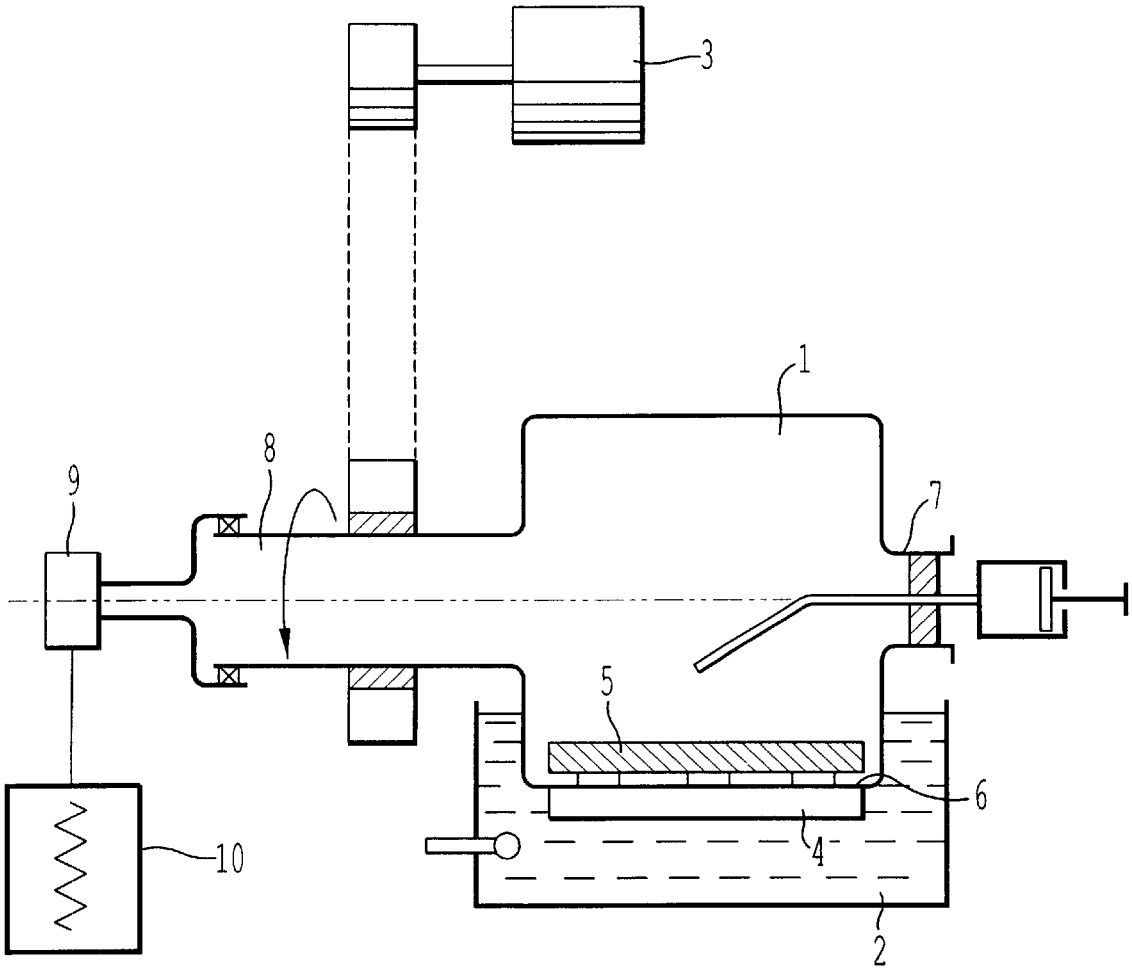

The present invention relates to a marine lubricant for a two-stroke engine with improved neutralization properties with respect to the sulphuric acid formed during the combustion of fuels, in particular fuel oils, said to have a high sulphur content, that is to say greater than 1% by weight. It relates more particularly to a lubricant exhibiting an improved neutralization capacity for sulphuric acid with respect to that of the marine lubricants on the market.

The marine oils used in slow-speed two-stroke crosshead engines are of two types. The cylinder oils, on the one hand, provide for the lubrication of the piston-cylinder assembly and the system oils, on the other hand, provide for the lubrication of all the moving parts outside the piston-cylinder assembly.

The matter under consideration here is the cylinder oils, for which the importance of the neutralization of the sulphuric acid is vital as they lubricate the part of the engine where combustion of the fuel takes place. In this part, the combustion residues, the acidic gases and the lubricating oil are in contact.

It is usual to characterize an oil by its BN or Base Number, which characterizes its basicity. It is measured, in the majority of cases, according to ASTM Standard D2896 and is expressed in equivalent by weight of potassium hydroxide per gram of oil or mg of KOH/g. The BN, until now, was a criterion of choice which makes it possible to adjust the basicity of the oil to the sulphur content of the fuel oil used, in order to be able to neutralize all the sulphur present in the fuel capable of being converted to sulphuric acid by combustion. Thus, the higher the sulphur content of a fuel oil, the higher the BN of a marine oil should be. This is why marine oils with BN values varying from 5 to 100 mg KOH/g are found on the market.

However, the Applicant Company has noticed that the BN is not representative of the neutralization phenomenon itself, as it takes place in the film of oil which provides for the lubrication in the piston-cylinder assembly. Thus, even for oils exhibiting a sufficiently high BN, corrosive wear phenomena related to the attack by sulphuric acid on the metal walls of the components concerned are commonly observed in the piston-cylinder assembly of the engines. The assessment of the neutralization cannot be made by the BN alone of the oil, as this parameter does not make it possible to predict the effectiveness of the basic additives present in the cylinder lubricants with respect to sulphuric acid condensed in the oil which, as has been demonstrated by A. Van Helden ("A Physico-Chemical Model of Corrosive Wear in Low Speed Engines", Report D-9, CIMAC 1987), involves diffusion processes which vary according to the chemical nature of these additives.

Thus, although the oils are nonpolar hydrocarbons, it is found that the acidic products from the combustion of the fuel oils, which are polar in nature and therefore difficult to dissolve in hydrocarbons, diffuse into the oils. This diffusion phenomenon varies according to various factors, such as the oil throughput, the rotational speed of the engine and the wettability of the metal surface. All these factors as well as the BN are important in predicting the corrosive wear by sulphuric acid. However, in order to prevent this corrosion, two factors are controllable by the manufacturers of lubricants, the BN and the wettability over the metal wall, which both depend on the chemical composition of the additives in the lubricating oil.

The Applicant Company has discovered that, in order to prevent corrosion, it is necessary to know the rate of neutralization of the sulphuric acid, diffused into the lubricant, by the basic compounds of the additives present. This is because, in order to be effective, these basic compounds have to react with the sulphuric acid before it reaches the metal walls of the cylinder and mainly in the film of oil formed in the cylinder where the corrosion phenomenon is greatest.

To achieve the desired basicity in the lubricants, that is to say a satisfactory BN, several additive compositions are recommended by the manufacturers of lubricants for marine engines.

Some of these manufacturers provide additive compositions including a mixture of detergents of phenate, salicylate and sulphonate types, such as disclosed in Patent EP 0,662,508 for low- and medium-speed diesel engines. Others recommend, for marine engines, lubricants comprising mixtures of overbased detergents of sulphonate type and of phenate type, the ratio by mass of which varies from (1:1) to (15:1), and which additionally include an ash-free borated dispersant of succinimide type, as disclosed in Patents EP 0,331,359 and U.S. Pat. No. 4,842,755.

The Applicant Company has unexpectedly found that a specific combination of detergent and dispersant additives makes it possible to improve the ability of the lubricant to neutralize the sulphuric acid produced during the combustion of sulphur-comprising hydrocarbons.

In fact, the present invention is targeted at a lubricant having a sufficient basicity and a sufficient speed of neutralization of the sulphuric acid formed to prevent the corrosive wear phenomena observed in the cylinders of slow-speed two-stroke crosshead engines.

A subject-matter of the present invention is therefore a lubricant for a slow-speed two-stroke crosshead marine engine, fed with a fuel with a sulphur content of greater than or equal to 1%, composed of a mixture of distillates used as lubricating bases including x% by weight of dispersant additive of succinimide type, y% by weight of overbased detergent additive of sulphonate type and z% by weight of overbased detergent additive of phenate type, characterized in that x, y and z are chosen within the ranges $0.5 \leqq x \leqq 2.5$, $3.5 \leqq y \leqq 10$ and $11 \leqq z \leqq 24.5$ such that $15 \leqq x+y+z \leqq 36$ and $1.5 \leqq y/x \leqq 13$, in that the BN of the lubricant, determined according to ASTM Standard D2896, is greater than or equal to 70 mg of KOH/g and in that the rate of neutralization by the lubricant of the sulphuric acid has a value greater than or equal to $11 \times 10^2$ Pa/s at 100° C., the rate of neutralization being defined by the maximum rate of increase in pressure in a closed chamber with walls covered with a film of the said lubricant with a thickness of 80 to 150 $\mu$m, which chamber is maintained at 100° C. and into which is introduced a known amount of sulphuric acid.

The advantage of the method used to measure the rate of neutralization of the sulphuric acid by the lubricant is to be able to reproduce the film of oil present in the cylinder part of the marine engine and the phenomenon of reaction of the sulphuric acid with the overbased detergents in the presence of dispersant and thus to approach a novel and more appropriate characteristic of the neutralizing capacity of these compositions. A more detailed description of the method used is given in Example I below.

By means of this device, the Applicant Company has found that, in order to promote the increase in the rate of neutralization, the said lubricant necessarily has to include a sufficient amount of a mixture of at least one overbased detergent of sulphonate type with at least one dispersant of succinimide type in order to prevent phenomena of corrosion by the sulphuric acid and that this mixture is synergistic.

The Applicant Company has made a specific selection of a mixture of additives in order to obtain a lubricant capable of rapidly neutralizing any acid invasion of the film formed inside the cylinder part of the motor, which is where acidic corrosion is generally observed.

In a preferred form of the invention, the y/x, overbased detergent of sulphonate type/dispersant of succinimide type, ratio by mass preferably varies from 1.5 to 5.

Among the accessible detergents, the preferred overbased detergents of sulphonate type are chosen from the group consisting of neutral and basic alkali metal and alkaline earth metal salts of petroleum sulphonic acids and of long-chain alkylarylsulphonic acids with BN values, determined by ASTM Standard D2896, varying from 300 to 500 mg of KOH/g. In a preferred embodiment, these sulphonate compounds are alkaline earth metal alkylarylsulphonates and preferably calcium mono- and dialkylarylsulphonates, each alkyl group comprising from 12 to 18 carbon atoms and the aryl group being a benzyl, a tolyl or a xylyl.

These overbased detergents of sulphonate type are effective with regard to the neutralization of the sulphuric acid in the lubricant film when they are taken in combination with at least one dispersant of succinimide type, this dispersant being chosen from the group consisting of succinimide derivatives from the group comprising polyalkenylsuccinimide borates, in which compounds the succinic acid or anhydride derives from a polymer of a $C_3$ or $C_4$ olefin, preferably from polyisobutylene with an average molecular mass of between 1000 and 3000, this acid or anhydride having reacted with a polyalkylenepolyamine from the group consisting of diethylenetriamine, triethylenetetramine, tetraethylenepentamine and their mixture, and in which compounds, for each polyalkenyl group, correspond from 1 to 2 succinimide groups.

However, in order to provide the lubricant with sufficient thermal resistance and to limit its oxidation, the lubricant comprises an overbased detergent of calcium phenate type, with a BN, determined by ASTM Standard D2896, varying from 50 to 400 mg of KOH/g, chosen from the group consisting of alkali metal and alkaline earth metal phenates of alkylphenols and of alkylmercaptophenols, the linear or branched alkyl groups comprising from 4 to 50 carbon atoms, preferably from 9 to 15 carbon atoms, taken alone or as a mixture.

Preference is given, among the detergents of phenate type of the invention, to a mixture of 95 to 100% by weight of calcium alkylmercaptophenates, the alkyl group comprising from 9 to 15 carbon atoms, with a BN varying from 200 to 400 mg of KOH/g, and of 0 to 5% by weight of a calcium alkylmercaptophenate with a BN of less than 150 mg of KOH/g, the alkyl group comprising from 9 to 15 carbon atoms.

In a preferred embodiment of the invention, for maximum effectiveness with regard to the neutralization of the sulphuric acid in the film, the said marine engine lubricant will advantageously include x% by weight of polyisobutylenesuccinimide, comprising one polyisobutylene group per 1.1 to 1.8 succinimide groups, y% by weight of calcium sulphonate with a BN of between 300 and 500 mg of KOH/g, z% by weight of a mixture of calcium alkylmercaptophenates and 64 to 85% by weight of a mixture of hydrocarbons composed of lubricating mineral bases with densities at 15° C. varying from 850 to 950 kg/m$^3$ known to a person skilled in the art.

The lubricant according to the invention can additionally comprise from 0 to 1% of other additives, in particular of an antifoaming additive.

Examples are given below targeted at illustrating the invention without, however, wishing to limit the scope thereof.

EXAMPLE I

The aim of the present example is to describe the method used to measure the rate of neutralization of a lubricant.

This method uses the device represented in FIG. 1. The latter is composed of a cylindrical glass container (1), heated by a thermostatically-controlled oil bath (2), into which is introduced the sample of lubricating composition to be tested, of a motor (3) which makes it possible to rotate the cylindrical container (1) about its axis of rotation and of two magnetic rods, one outside (4) and the other inside (5) the said container (1), so as to form a film with a thickness of 100 $\mu$m on the glass wall (6). The cylindrical glass container (1) is connected at one of its flat ends to a tube (7) equipped with a septum which makes possible the introduction of acid with a syringe and, at the other end, to an expansion vessel (8) equipped with a pressure sensor (9) which makes it possible to monitor the variations in pressure inside the combined cylindrical container/expansion vessel (1)/(8) throughout the period of introduction of the acid and even during the neutralization. A recorder (10) is connected to the said sensor (9), on which are monitored the variations in pressure in the combined cylindrical container/expansion vessel (1)/(8).

In order to quantitatively measure the rate of neutralization of the lubricant, 2 g of the said lubricant are introduced into the cylindrical container (1), then, by starting up the motor (3) at 1.5 revolutions/min, a homogeneous oil film (5) is formed on the walls of the said cylindrical container (1) and the temperature of the bath (2) is adjusted to 100° C. in order to obtain a homogeneous film. It is not possible to obtain this homogeneous film, which is also formed inside a two-stroke engine, if the bath is at an insufficient temperature. Finally, the recording of the internal pressure of the system is begun and 2 ml of 95% sulphuric acid are introduced in less than 0.5 second.

Figure 2:
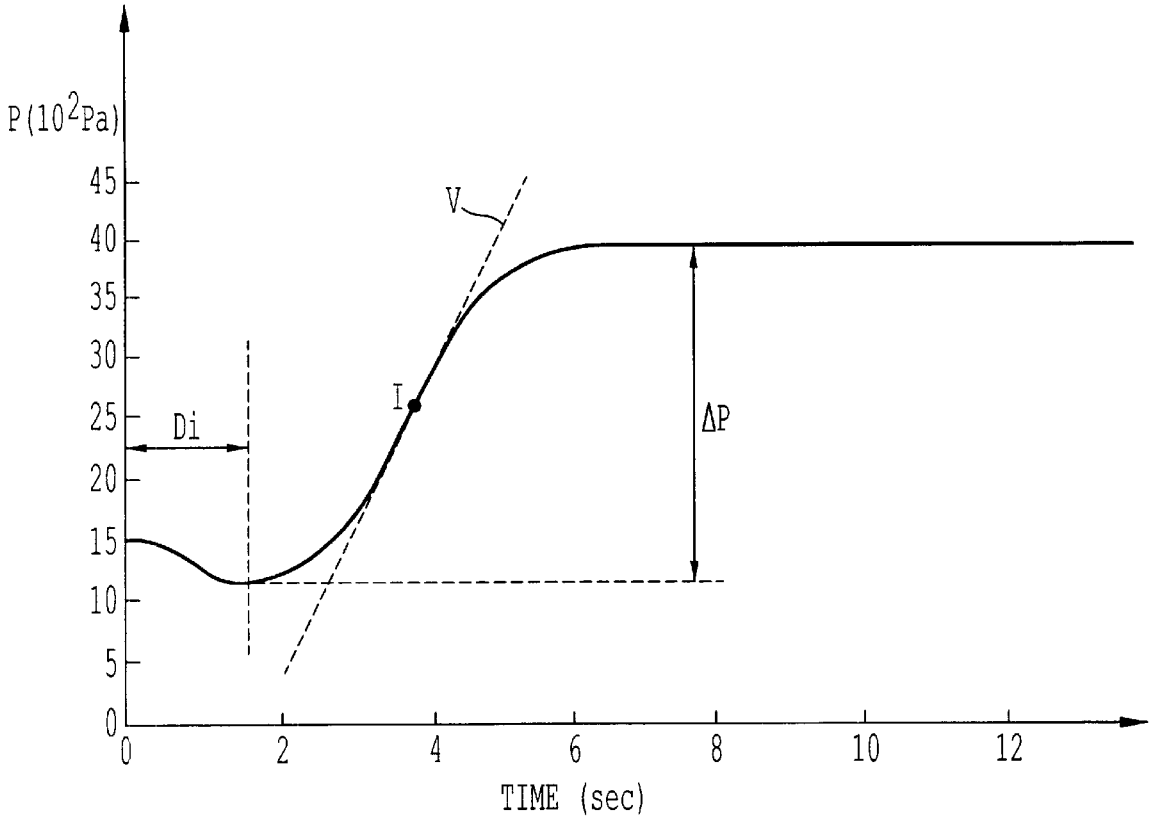

FIG. 2 shows a recording of the variation in pressure for the test described. The curve comprises three phases, the phase 1 of initiation of the reaction, a phase 2 of neutralization, the slope of which allows the rate of neutralization to be calculated, and a phase 3 of stabilization of the pressure in the cylindrical container (1).

EXAMPLE II

The present example is targeted at showing the influence of the chemical composition of the lubricant or of its BN on the rate of neutralization as measured according to the method and with the device described in the preceding Example I.

The lubricant samples are prepared with a mineral base obtained by mixing at least one distillate 1, with a density at 15° C. of between 880 and 895 kg/m$^3$ with a distillate 2, with a density at 15° C. of between 890 and 910 kg/m$^3$ (bright stock), in a distillate 1/distillate 2 ratio of 3.5.

The amounts of calcium sulphonate with a BN equal to 400 mg of KOH/g, of a dispersant L890 sold by Lubrizol, of a first calcium phenate, with a BN of 250 mg of KOH/g, and of a second calcium phenate, with a BN of 100 mg of KOH/g, needed to obtain lubricant samples with a BN of 40 mg of KOH/g or of 70 mg of KOH/g were added to this mixture of distillates.

The respective rates of neutralization of the lubricant samples with a BN equal either to 40 mg of KOH/g or to 70 mg of KOH/g, the sulphonate/dispersant ratios by mass of which are varied for a constant content of calcium phenates with a BN of 250 and with a BN of 100 in the lubricant, are combined in Table I below.

TABLE I

| Sulphonate/ dispersant | Rate of neutralization ($10^2$ Pa/s) BN 40 | BN 70 |
|---|---|---|
| 3.2 | 7.31 | 18.6 |
| 4.46 | 4.15 | 11.80 |
| 13 | 2.70 | 7.5 |
| 18 | 2.38 | 6.95 |

These results in Table I show the synergy which exists between the sulphonate compounds and dispersants of the invention with regard to the rate of neutralization of the sulphuric acid in a film reproduced by means of the device of Example I.

The respective rates of neutralization of the lubricant samples for which the sulphonate/dispersant ratio by mass remains constantly equal to 4.46 and for which the BN is varied from 40 to 100 mg of KOH/g, that is to say by varying the degree of dilution of the additives in the mixture of distillates, are combined in Table II below.

TABLE II

| Sulphonate/dispersant | | | |
|---|---|---|---|
| 4.46 | | 8 | |
| BN (mg of KOH/g) | Rate of neutralization ($10^2$ Pa/s) | BN (mg of KOH/g) | Rate of neutralization ($10^2$ Pa/s) |
| 40 | 4.15 | 40 | 3.18 |
| 55 | 7.96 | 55 | 5.23 |
| 70 | 11.80 | 70 | 8.32 |
| 80 | 14.05 | 80 | 10.83 |
| 100 | 20.62 | 100 | 16.14 |

These two tables emphasize the influence of the various characteristics of BN and of sulphonate/dispersant ratio by mass on the achievement of a satisfactory rate of neutralization.

However, in addition, it is apparent that the choice of the BN or of the sulphonate/dispersant ratio alone is insufficient to produce an optimum rate of neutralization for a satisfactory concentration of additive. It is thus clear that, in order to obtain a finished lubricant exhibiting efficient neutralization of the sulphuric acid, it is necessary to adjust the three characteristics of BN, of overbased detergent of sulphonate type/dispersant of succinimide type ratio and of rate of neutralization of the lubricant film.

What is claimed is:

1. A lubricant for a slow-speed two-stroke crosshead marine engine, fed with a fuel with a sulphur content of greater than or equal to 1%, comprising: a mixture of distillates used as lubricating bases including x% by weight of succinimide dispersant additive, y% by weight of overbased sulphonate detergent additive and z% by weight of overbased phenate detergent additive, wherein x, y and z are chosen within the ranges $0.5 \leqq x \leqq 2.5$, $3.5 \leqq 5 \leqq 10$, $11 \leqq z \leqq 24.5$, $15 \leqq x+y+z \leqq 36$ and $1.5 \leqq y/x \leqq 5$, wherein the BN of the lubricant, determined according to ASTM Standard D-2896, is greater than or equal to 70 mg of KOH/g, and wherein the rate of neutralization by the lubricant of sulphuric acid is greater than or equal to $11 \times 10^2$ Pa/s at 100° C., the rate of neutralization being defined by the maximum rate of increase in pressure in a closed chamber with walls covered with a film of the said lubricant with a thickness of 80 to 150 $\mu$m, which chamber is maintained at 100° C. and in which is vaporized a known amount of sulphuric acid.

2. The lubricant according to claim 1, wherein the overbased sulphonate detergents are chosen from the group consisting of basic alkali metal and alkaline earth metal salts of petroleum sulphonic acids and of long chain alkylarylsulphonic acids with BN values, determine by ASTM Standard D-2896, varying from 300 to 500 mg of KOH/g.

3. The lubricant according to claim 2, wherein the overbased sulphonate detergents are alkaline earth metal alkylarylsulphonates, each alkyl group comprising from 12 to 18 carbon atoms and the aryl group being a benzyl, a tolyl or a xylyl.

4. The lubricant according to claim 2, wherein the overbased sulphonate detergents are calcium mono- and dialkylarysulphonates, each alkyl group comprising from 12 to 18 carbon atoms and the aryl group being a benzyl, a tolyl or xylyl.

5. The lubricant according to claim 1, wherein the succinimide dispersant is chosen from the group consisting of polyalkenylsuccinimide borates, in which compounds the succinic acid or anhydride is substituted with a polymer of a $C_3$ or C4 olefin, with an average molecular mass of between 1000 and 3000, the acid or anhydride having reacted with a polyalkylenepolyamine from the group consisting of diethylenetriamine, triethylenetetramine, tetraethylenepentamine and their mixture, and in which compounds, for each polyalkenyl group, contains from 1 to succinimide groups.

6. The lubricant according to claim 1, wherein the overbased phenate detergent is chosen from the group consisting of alkali metal and alkaline earth metal phenates of alkylphenols and of alkylmercaptophenols, the linear or branched alkyl groups comprising from 4 to 50 carbon atoms, taken alone or as a mixture, so that its BN, determine by ASTM Standard D-2896, varies from 50 to 400 mg of KOH/g.

7. The lubricant according to claim 6, wherein the overbased phenate detergent comprises 95 to 100% by weight of calcium alkylmercaptophenates with a BN varying from 200 to 400 mg of KOH/g, the alkyl group comprising from 9 to 15 carbon atoms, and 0 to 5% by weight of a calcium alkylmercaptophenate with a BN of less than 150 mg of KOH/g, the alkyl group comprising from 9 to 15 carbon atoms.

8. The lubricant according to claim 1 wherein it includes x% by weight of polyisobutylenesuccinimide, comprising one polyisobutylene, comprising one polyisobutylene group per 1.1 to 1.8 succinimide groups, y% by weight of calcium sulphonate with a BN of between 300 and 500 mg of KOH/g, z% by weight of a mixture of calcium alkylmercaptophenates and 64 to 85% by weight of a mixture of hydrocarbons composed of lubricating minerals bases with densities at 15° C. varying from 850 to 950 kg/m$^3$.

9. The lubricant according to claim 1, wherein it includes from 0 to 1% by weight of other additives.

10. The lubricant according to claim 1, wherein the succinimide dispersant is chosen from the group consisting of polyalkenylsuccinimide borates, in which compounds the succinic acid or anhydride is substituted with a polyisobutylene with an average molecular mass of between 1000 and 3000, the acid or anhydride having reacted with a polyalkylenepolyamine from the group consisting of diethylenetriamine, triethylenetetramine, tetraethylenepentamine and their mixture, and in which compounds, for each polyalkenyl group, contains from 1 to succinimide groups.

11. The lubricant according to claim 1, wherein the overbased phenate detergent is chosen from the group consisting of alkali metal and alkaline earth metal phenates of alkylphenols and of alkylmercaptophenols, the linear or branched alkyl groups comprising from 9 to 15 carbon atoms, taken alone or as a mixture, so that its BN, determined by ASTM Standard D-2896, varies from 50 to 400 mg of KOH/g.

12. The lubricant according to claim 1, wherein it includes from 0 to 1% by weight of an antifoaming additive.

* * * * *